United States Patent [19]

Romer

[11] Patent Number: 4,573,881

[45] Date of Patent: Mar. 4, 1986

[54] REFRIGERATION COMPRESSOR HAVING A TUBULAR INSERT OF THERMALLY INSULATING MATERIAL IN SUCTION PASSAGE

[75] Inventor: Bendt W. Romer, Sonderborg, Denmark

[73] Assignee: Danfoss A/S, Nordborg, Denmark

[21] Appl. No.: 736,271

[22] Filed: May 20, 1985

Related U.S. Application Data

[63] Continuation of Ser. No. 642,077, Aug. 20, 1984, abandoned.

[30] Foreign Application Priority Data

Sep. 7, 1983 [DE] Fed. Rep. of Germany ..... 3332259

[51] Int. Cl.[4] ..... F04B 39/12

[52] U.S. Cl. ..... 417/312; 417/313; 417/902

[58] Field of Search ..... 417/312, 313, 415, 902; 62/296; 181/403

[56] References Cited

U.S. PATENT DOCUMENTS

| | | | |
|---|---|---|---|
| 2,504,528 | 4/1950 | Hume | 417/902 X |
| 3,396,908 | 8/1968 | Vind | 417/902 X |
| 3,513,476 | 5/1970 | Monden et al. | 417/902 X |
| 3,514,225 | 5/1970 | Monden et al. | 417/902 X |
| 4,239,461 | 12/1980 | Elson | 417/312 |
| 4,370,104 | 1/1983 | Nelson et al. | 417/312 |
| 4,401,418 | 8/1983 | Fritchman | 417/312 |
| 4,411,600 | 10/1983 | Itagaki et al. | 417/312 |
| 4,486,153 | 12/1984 | Romer et al. | 417/313 |

*Primary Examiner*—Carlton R. Croyle
*Assistant Examiner*—Paul F. Neils
*Attorney, Agent, or Firm*—Wayne B. Easton

[57] ABSTRACT

The invention relates to an encapsulated motor-compressor unit for a refrigerator. The unit includes a capsule in which is resiliently mounted a combined or integrated motor and compressor having a common housing casting. The housing casting defines a cylinder for receiving a piston and a sound damping chamber. The housing casting has pressure and suction chambers at one end thereof and a suction passage which extends from the sound damping chamber to the suction chamber. The efficiency of the unit is improved by providing a tubular insert of thermally insulating material in the suction passage to reduce the transfer of heat from the compressor cylinder to the inlet gas in the suction passage.

10 Claims, 3 Drawing Figures

Figure 1:
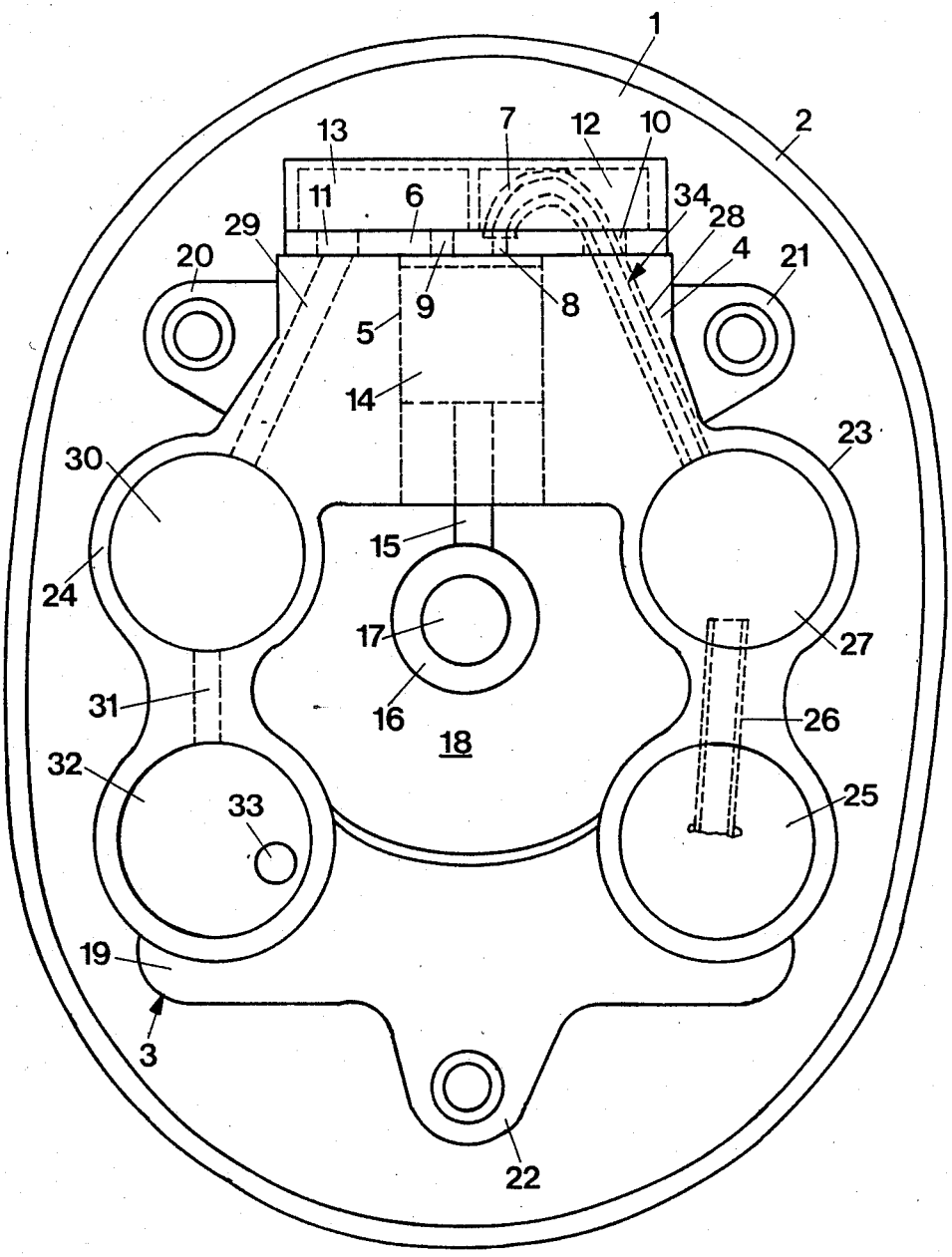

Fig. 2
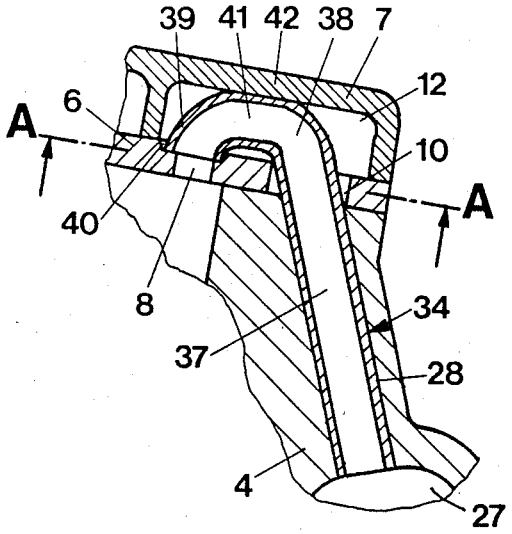
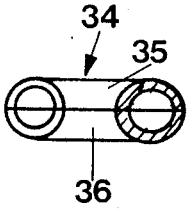
Fig. 3

REFRIGERATION COMPRESSOR HAVING A TUBULAR INSERT OF THERMALLY INSULATING MATERIAL IN SUCTION PASSAGE

This application is a continuation of application Ser. No. 642,077 filed Aug. 20, 1984, now abandoned.

The invention relates to a refrigerator compressor in which a cylinder block formed in one piece with at least one suction sound damping chamber is covered at the end by a valve plate with a suction passage orifice and a suction valve orifice and comprises a suction passage extending from its end to the suction sound damping chamber.

Such a refrigerator compressor is, for example, known from DE-PS No. 32 13 476 (F 25 B 43/00). The one-piece construction of the sound damping chambers and cylinder simplifies construction because fewer parts have to be interconnected, and it increases the strength. The suction passage extending in the cylinder block next to the cylinder is, however, to a large extent subjected to the heat of compression. Consequently, the temperature of the gas fed to the suction valve rises, with the result that the degree of filling of the compressor and consequently its efficiency drops. The hottest point of the compressor is in the region of the pressure valve which is likewise formed on the valve plate. Accordingly, heat from the valve plate and the cylinder head is transmitted to the refrigerant in the suction valve chamber.

It is also already known (U.S. Pat. No. 42 39, 461) to make the suction sound damper and the suction passage conduit leading to the cylinder block from a plastics material in order to reduce nose and minimise the transfer of heat from the cylinder to the suction gas. However, such a compressor has a low strength.

The invention is based on the problem of providing a refrigerator compressor of the aforementioned kind in which the efficiency is improved by reducing the transfer of heat to the suction gas.

This problem is solved according to the invention in that a tubular insert of thermally insulating material is inserted in the suction passage.

Such an arrangement retains all the advantages of the known refrigerator compressor. However, the insert prevents or reduces the transfer of heat in the suction passage where there would otherwise be particularly intensive heat transfer because this passage is disposed in the vicinity of the cylinder and, on account of the limited cross-section, substantially all parts of the gaseous refrigerant come into contact with the wall of the passage. The additional expense is minimal because the insert need merely be pushed into the passage. Since comparatively thin wall thicknesses are sufficient for the thermal insulation, the insert can be used without alteration or, at most, with slight enlargement of the suction passage.

It is particularly favourable if the tubular insert also passes through the suction passage orifice of the suction valve plate and an arcuate terminal section leads direct to the suction valve orifice. In this way, the suction gas is thermally insulated up to the suction valve. There is therefore no danger of undesired heating in a suction valve chamber preceding the suction valve.

The terminal section may by all means extend in the known suction valve chamber. This has the advantage that the compressor construction need not be changed and that any leakages between the insert and the suction passage on the one hand and the suction valve orifice on the other hand are insignificant.

Preferably, the cross-section of the terminal section is smaller in the direction of stroke than is the diameter of the insert in the suction passage. A shallower suction valve chamber will therefore suffice, as is conventional per se, even though it accommodates the arcuate terminal section.

Preferably, the suction valve orifice is surrounded by an annular depression for receiving the end of the terminal section. This secures the position of the insert against rotation. In addition, the end of the terminal section can be pressed against the bottom of the depression for sealing purposes.

This takes place particularly in that the terminal section is pressed through the end wall of the suction valve chamber against the valve plate. With appropriate dimensioning of the parts, such pressing will set in automatically assembly.

In a preferred embodiment, the insert is of refrigeration-proof thermally insulating plastics material. Comparatively thin wall thicknesses will then suffice to achieve adequate thermal insulation.

Desirably, the insert is cast or injected in a mould. This is the best way of achieiving the desired shape of the insert.

Preferably, the insert consists of two shell segments. These can be easily manufactured in the mould. In particular, no cores have to be removed subsequently. These shell segments can be pushed into the suction passage together. Prior connection is generally not necessary. An absolute seal does not have to be provided for the insert if it is merely arranged within the scope of the known sealed suction passage system and/or the compressor is arranged in an evacuated capsule as is usual in the majority of cases.

Preferred plastics materials for the insert are a polyether provided with benzene rings, for example that marketed under the name 'Ryton', or a fluoro-containing polymer such as that marketed under the name 'Halar 500', or polytetrafluoroethylene such as that marketed under the name 'Teflon'.

A preferred example of the invention will now be described in more detail with reference to the drawing, wherein:

FIG. 1 is a diagrammatic plan view of a refrigerator compressor according to the invention, FIG. 2 is a section in the region of the insert, and FIG. 3 is a section through the insert on the line A—A in FIG. 2.

A motor compressor 3 is arranged in the interior 1 of a capsule 2. A cylinder block 4 comprises a cylinder 5 and is provided at the end with a valve plate 6 and a cylinder head 7. The valve plate carries a suction valve orifice 8, a pressure valve orifice 9, a suction passage orifice 10 and a pressure passage orifice 11. The associated suction valve and pressure valve pressure valve plates have been omitted for clarity. The cylinder head 7 contains a suction valve chamber 12 and a pressure valve chamber 13. A piston 14 is connected by way of a connecting rod 15 and a connecting rod end 16 with the crank 17 of a crank shaft which is driven by the rotor 18 of an electric motor which also has a stator 19. This motor compressor 3 has extensions 20, 21, 22 engaged by coiled springs secured to the capsule 2.

Connected in one piece to the cylinder block 4 there is a suction sound damper extension 23 and a pressure sound damper extension 24. In the suction sound damper extension 23 there is a first suction sound damper 25 connected to the suction side in a manner not shown. By way of a passage 26 forming a throttle point, it communicates with a second suction sound damper chamber 27. From there, a suction passage 28 in cylinder block 4 leads to the suction valve chamber 12 by way of the suction chamber orifice 10. A pressure passage 29 in cylinder block 4 is connected by way of the pressure passage orifice 11 to the pressure valve chamber 13 and leads to a first pressure sound damping chamber 30 in the pressure sound damper extension 24. From there, a bore 31 forming a throttle passage leads to a second pressure sound damper 32. This is adjoined by the pressure conduit 33 leading to the outside.

As will be explained in more detail with reference to FIGS. 2 and 3, an insert 34 of refrigeration-proof and thermally insulating plastics material is pushed into the suction passage 28. The insert 34 is composed of two segments 35 and 36 which are superposed substantially in the plane of the drawing of FIG. 2. The insert has a straight section 37 extending through the suction passage 28 and through the suction passage orifice 10 and a curved terminal section 38 which extends in the suction valve chamber 12 and engages with its end 39 in an annular depression 40 surrounding the suction valve orifice 8 in the form of a step. In its central region 41, the terminal section has a flattened shape such that the cross-sectional dimension in the direction of the stroke of the piston 14 is smaller than the diameter in the region of the suction passage 28. The end wall 42 of the suction valve chamber presses on the curved terminal section 38 so that the end 39 is held against the base of the depression 40.

In this way, suction gas flowing to the suction valve from the suction sound damper chamber 27 is substantially protected from being heated along its entire path until entering the suction valve, such heating otherwise being possible in the region of the cylinder 5 by reason of the higher temperature of the cylinder block 4.

I claim:

1. An encapsulated refrigerator motor compressor, comprising, a capsule, a compressor unit resiliently mounted in said capsule, a cylinder block casting for said compressor unit, said casting defining a cylinder chamber for receiving a piston and a sound damping chamber, means attached to said casting forming pressure and suction valve chambers adjacent the outer end of said cylinder, valve plate means between said chambers and said cylinder, a suction gas inlet passage in said casting adjacent said cylinder and extending between said sound damping chamber and said suction valve chamber, and insulation means for reducing the transfer of heat to suction gas in said suction gas inlet passage and in said suction valve chamber, said insulation means comprising said valve plate means including a suction valve orifice between said suction valve chamber and said cylinder and a suction passage orifice between said suction valve chamber and said suction gas inlet passage, a tubular insert of thermally insulating material inserted in said suction gas inlet passage and extending through said suction passage orifice in said valve plate means and through said suction valve chamber to said suction valve orifice in said valve plate means.

2. An encapsulated refrigerator motor compressor according to claim 1 characterized in that said suction valve orifice is counterbored for receiving the end of said tubular insert.

3. An encapsulated refrigerator motor compressor according to claim 1 characterized in that said insert consists of a polyether with benzene rings.

4. An encapsulated refrigerator motor compressor according to claim 1 characterized in that said insert consists of a fluorocontaining polymer.

5. An encapsulated refrigerator motor compressor according to claim 1 characterized in that said insert consists of polytetrafluoroethylene.

6. An encapsulated refrigerator motor compressor according to claim 13 characterized in that said tubular insert has an arcuate end section which leads directly to said suction valve orifice.

7. An encapsulated refrigerator motor compressor according to claim 6 wherein said insert end section extends through said suction valve chamber.

8. An encapsulated refrigerator motor compressor according to claim 1 characterized in that said insert is of a thermally insulating plastics material.

9. An encapsulated refrigerator motor compressor according to claim 8 characterized in that said insert comprises at least one molded part.

10. An encapsulated refrigerator motor compressor according to claim 9 characterized in that said insert consists of two shell segments extending longitudinally of said insert.

* * * * *